United States Patent [19]

Lauton et al.

[11] 4,439,201

[45] Mar. 27, 1984

[54] PROCESS FOR RETANNING LEATHER WITH ACRYLIC-BASED OLIGOMERS

[75] Inventors: Alain Lauton, Saint-Louis, France; Albert Würmli, Riehen, Switzerland

[73] Assignee: Ciba-Geigy Corporation, Ardsley, N.Y.

[21] Appl. No.: 353,114

[22] Filed: Mar. 1, 1982

[30] Foreign Application Priority Data

Mar. 6, 1981 [CH] Switzerland ..... 1528/81
Dec. 22, 1981 [CH] Switzerland ..... 8201/81

[51] Int. Cl.[3] ..... C14C 3/22; C14C 3/28

[52] U.S. Cl. ..... 8/436; 8/94.21; 8/94.33

[58] Field of Search ..... 8/436, 94.21; 252/8.57

[56] References Cited

U.S. PATENT DOCUMENTS

| | | | |
|---|---|---|---|
| 2,205,882 | 6/1940 | Graves | 8/94.33 |
| 2,205,883 | 6/1940 | Graves | 8/94.33 |
| 2,893,977 | 7/1959 | Suen et al. | 524/52 |
| 3,103,447 | 9/1963 | Lowell et al. | 428/473 |
| 3,408,319 | 10/1968 | Rau | 8/94.21 |
| 3,646,099 | 2/1972 | Dannals | 260/465.4 |
| 3,774,969 | 7/1973 | Alps et al. | 299/76 |
| 3,893,977 | 7/1975 | Wingler | 528/45 |
| 3,945,792 | 3/1976 | Würmli et al. | 8/94.21 |
| 4,150,944 | 4/1979 | Würmli | 528/158 |

FOREIGN PATENT DOCUMENTS

| | | | |
|---|---|---|---|
| 3005699 | 8/1981 | Fed. Rep. of Germany | 8/94.21 |
| 566585 | 1/1945 | United Kingdom | 8/94.33 |

*Primary Examiner*—Maria Parrish Tungol
*Attorney, Agent, or Firm*—Edward McC. Roberts

[57] ABSTRACT

The invention relates to oligomers containing structural units of the formulae

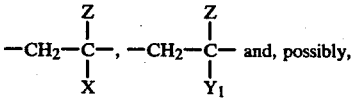

and, possibly,

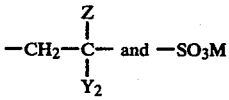

wherein $X_1$ is —CN, —$COOR_1$, —$OOCR_2$ or —$CONHR_3$, $Y_1$ is —COOH or —$COOM_2$, $Y_2$ is —$CONH_2$, —$CH_2OH$, —$OCH_3$ or —$OC_2H_5$, each of $Z_1$, $Z_2$ and $Z_3$ is hydrogen, methyl or ethyl, each of $M_1$ and $M_2$ is an amine cation, an ammonium cation or an alkali metal cation, and each of $R_1$, $R_2$ and $R_3$ is $C_1$–$C_8$alkyl, $C_1$–$C_8$-hydroxyalkyl or alkoxyalkyl containing altogether at most 8 carbon atoms, fatliquoring the treated leather and drying it, and, if appropriate, additionally dyeing said treated leather before or after it has been fatliquored.

These oligomers are suitable for use as tanning agents in a process for retanning chrome-tanned leather. The oligomers are prepared by copolymerizing comonomers of the acrylic acid series corresponding to the structural units of the indicated formulae, in the presence of sulfite or hydrogen sulfites of the formulae $SO_3(M)_2$ or $HSO_3M$, and have an average molecular weight of at most 14,000.

7 Claims, No Drawings

PROCESS FOR RETANNING LEATHER WITH ACRYLIC-BASED OLIGOMERS

A process for retanning leather, wherein the tanning agent employed is a sulfonated reaction product which is obtained by reacting a sulfonation product, which is previously formed from e.g. diphenyl ether, phenol and oleum, with e.g. dimethylol urea or formaldehyde, is disclosed in U.S. patent specification No. 4,150,944.

It has now been found that, instead of using the reaction product of the above kind, a very readily obtainable oligomer having at least the same tanning action, can advantageously be used for retanning leather.

Accordingly, the present invention relates to a process for retanning chrome-tanned dyed or undyed leather, which process comprises treating the leather with an aqueous solution which contains, as tanning agent, an oligomer containing structural units of the formulae

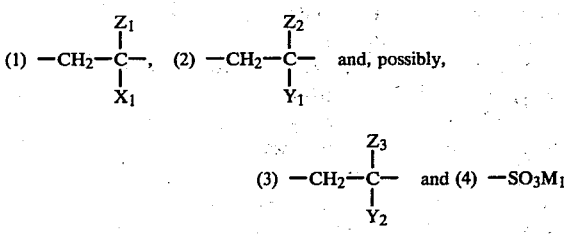

or of the formulae (1), (2), (4) and, possibly, (3), wherein $X_1$ is —CN, —$COOR_1$, —$OOCR_2$ or —$CONHR_3$, $Y_1$ is —COOH or —$COOM_2$, $Y_2$ is —$CONH_2$, —$CH_2OH$, —$OCH_3$ or —$OC_2H_5$, each of $Z_1$, $Z_2$ and $Z_3$ is hydrogen, methyl or ethyl, each of $M_1$ and $M_2$ is an amine cation, an ammonium cation or an alkali metal cation, and each of $R_1$, $R_2$ and $R_3$ is $C_1$–$C_8$alkyl, $C_1$–$C_8$-hydoxyalkyl or alkoxyalkyl containing altogether at most 8 carbon atoms, fatliquoring the treated leather and drying it, and, if appropriate, additionally dyeing said treated leather before or after it has been fatliquored.

The aqueous solution for carrying out the retanning process and containing the oligomer as tanning agent, the retanned leather obtained by said process and the use of the oligomer as tanning agent, constitute further objects of the present invention.

The oligomers containing the structural units of the formulae (1), (2) and (4) are known per se and described e.g. in U.S. patent specification No. 3,646,099 as conductive and surface-active agents. The oligomers which, in addition to containing the structural units (1) and (2), also contain the structural units of the formula (3), are disclosed as components of resin compositions having good adhesive properties in U.S. patent specification No. 2,893,977.

Although the oligomers disclosed in the two above mentioned patent specifications are prepared in the presence of sulfites or hydrogen sulfites, they contain in one case structural units of the formula (4), but not in the other. Analytical investigations show that oligomers which, after the known preparation in the presence of sulfites or hydrogen sulfites, are precipitated from their aqueous solutions by the addition of strong acids, e.g. hydrochloric acid, contain no, or only traces of, structural units of the formula (4). It must therefore be assumed that, after preparation of the oligomers in aqueous solution, sulfite or hydrogen sulfite is present solely, or at least principally, as mixture component and not as structural unit of the oligomer in the form of the formula (4). As oligomers which are precipitated with hydrochloric acid produce the same results when used as tanning agents as oligomers which have not been precipitated, the presence or absence of structural units of the formula (4) is not a crucial feature of the oligomers employed in the practice of this invention. However, the oligomers employed in the retanning process of this invention do not need to be precipitated before use.

An essential feature of the oligomers of this invention is, in addition to the presence of the structural units of the formulae (1), (2) and, possibly, (3), the relatively low average molecular weight, which is at most 14,000, in particular 3000 to 12,000, preferably 3000 to 10,000, most preferably 4000 to 9000. These relatively low molecular weights of the oligomers of this invention as compared with the high molecular polymers used e.g. in the plastics industry for the manufacture of synthetic fibres, are contingent on the use of sulfites or hydrogen sulfites in the preparation of the oligomers.

On account of their average molecular weights, preferred oligomers employed in the process of this invention as tanning agents contain 2 to 75, preferably 5 to 40, most preferably 10 to 25, structural units of each of the formulae (1) and (2), and 0 to 25, preferably 0 to 10, most preferably 0 to 5, structural units of the formula (3).

Suitable oligomers in respect of their use as tanning agents are those which, in addition to containing structural units of the formulae (2) and, possibly, (3), contain structural units of the formula

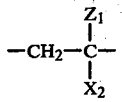

(1.1)

wherein $X_2$ is —CN, —$COOR_4$, —$OOCR_5$ or —$CONHR_6$, $R_4$ is $C_1$–$C_4$-alkyl, $C_1$–$C_4$hydroxyalkyl or methoxyalkyl containing altogether at most 4 carbon atoms, $R_5$ is methyl or ethyl, $R_6$ is alkyl of 1 to 8 carbon atoms or hydroxyalkyl of 1 or 2 carbon atoms, and $Z_1$ is as previously defined; and, in particular, structural units of the formula

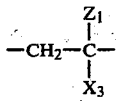

(1.2)

wherein $X_3$ is —CN, —$COOCH_3$, —$COOC_2H_5$, —$COOC_2H_4OH$, —$COOC_3H_6OH$, —$COOC_2H_4OCH_3$, —$OOCCH_3$, —$CONHCH_3$, —$CONHC_2H_5$, —$CONHCH_2OH$, —$CONHC_3H_7$ or —$CONHC_8H_{17}$, and $Z_1$ is as previously defined.

Oligomers which are especially suitable for use as tanning agents contain structural units of the formulae

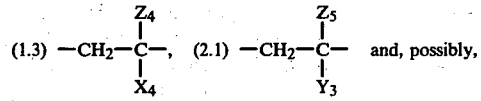

-continued $$(3.1)\ -CH_2-\underset{Y_4}{\overset{Z_6}{C}}- \quad \text{and} \quad (4.1)\ -SO_3M_3$$

wherein $X_4$ is —CN, $—COOCH_3$, $—COOC_2H_5$, $—COOC_2H_4OH$, $—COOC_3H_6OH$, $—OOCCH_3$, $—OOCC_2H_5$, $—CONHCH_3$, $—CONHC_2H_5$, $—CONHC_3H_7$ and $—CONHC_8H_{17}$, $Y_3$ is —COOH or $—COOM_4$, $Y_4$ is $—CONH_2$, $—CH_2OH$ or $—OCH_3$, each of $M_3$ and $M_4$ is a sodium cation, potassium cation or ammonium cation, and each of $Z_4$, $Z_5$ and $Z_6$ is hydrogen or methyl.

Preferred oligomers as tanning agents contain structural units of the formulae $$(1.4)\ -CH_2-\underset{CN}{CH}-, \quad (2.2)\ -CH_2-\underset{COONa}{CH}- \quad \text{and, possibly,}$$

$$(3.2)\ -CH_2-\underset{CONH_2}{CH}- \quad \text{and} \quad (4.2)\ -SO_3Na$$

The preparation of the known oligomers is carried out by methods which are known per se, e.g. those described in U.S. patent specifications 3,646,099 and 3,893,977, by reacting the compounds of the formulae $$(5)\ CH_2=\underset{X_1}{\overset{Z_1}{C}}, \quad (6)\ CH_2=\underset{Y_1}{\overset{Z_2}{C}} \quad \text{and, possibly,} \quad (7)\ CH_2=\underset{Y_2}{\overset{Z_3}{C}}.$$

wherein $X_1$, $Y_1$, $Y_2$, $Z_1$, $Z_2$ and $Z_3$ have the meanings previously assigned to them, always in the presence of compounds of the formulae $$SO_3(M_1)_2 \qquad (8)$$

or $$HSO_3M_1, \qquad (9)$$

wherein $M_1$ has the given meanings, in aqueous medium and optionally in the presence of a polymerisation catalyst at a maximum temperature of 70° C., and adjusting the aqueous reaction mixture at this temperature with a base of the formula $$M_2OH, \qquad (10)$$

wherein $M_2$ is as previously defined, to a pH value of 5 to 7.

The preferred procedure is to charge the reactor with 2 to 75, preferably 5 to 40 and, most preferably, 10 to 25 moles, of each of the starting monomers (5), (6) and optionally (7) per mole or per equivalent of the starting compounds of the formula (8) or (9), the sequence normally being to add first component (5) and then component (6) and optionally component (7), in order to avoid a homopolymerisation of the generally more reactive component (6), then to add to the monomers small amounts [e.g. 1/20 to 1/5 (5) to (9)] of a polymerisation catalyst such as azoisobutyronitrile, or preferably to add a peroxide such as benzoyl peroxide or, in particular, ammonium persulfate (i.e. the compound of the formula $(NH_4)_2S_2O_8$) in small portions, e.g. in 8 to 12 portions, to the aqueous solution of the starting compounds, or continuously over 5 to 8 hours, whereupon an exothermic polymerisation reaction commences. Conveniently the reaction mixture is cooled such that the temperature does not exceed 70° C., preferably 40° C. In a preferred temperature range of 50° to 55° C., the polymerisation is usually complete 4 to 6 hours after the addition of catalyst. When the polymerisation is complete, the reaction mixture is adjusted to an advantageous pH value of about 5 to 7, preferably 6.1 to 6.3, by addition of a compound of the formula (10), with cooling, such that the temperature indicated above is not exceeded, to give an aqueous, gel-like solution of the copolymer. After addition of the compound of the formula (10), the reaction can, if necessary, be kept for 6 to 10 hours under reduced pressure (−10 to −1 bar) at 60° to 80° C. in order to remove completely any non-polymerised starting compounds.

Accordingly, for example, a terpolymer which contains structural units of the formula (1.2), (2.1), (3.1) and, possibly, (4.1), is prepared by copolymerising sodium, potassium or ammonium sulfite, or sodium, potassium or ammonium hydrogen sulfite, as examples of specific representatives of starting compounds of the formula (8) or (9); acrylonitrile, methacrylonitrile, ethylacrylonitrile methyl acrylate, ethyl acrylate, methyl methacrylate, ethyl methacrylate, hydroxyethyl acrylate, hydroxyethyl methacrylate, hydroxypropyl acrylate, hydroxypropyl methacrylate, methoxyethyl acrylate, vinyl acetate, vinyl propionate, N-methylacrylamide, N-ethylacrylamide, N-methylolacrylamide, N-isopropylacrylamide or N-isooctylacrylamide as examples of specific representatives of the monomer of formula (5); acrylic acid, methacrylic acid or α-ethylacrylic acid as examples of specific representatives of the monomer of formula (6); and acrylamide, methacrylamide, vinyl methyl ether or allyl alcohol as examples of specific representatives of the monomer of formula (7), with one another, and subsequently neutralising the reaction mixture with sodium hydroxide, potassium hydroxide or ammonia, as examples of specific representatives of the base of formula (10).

When returning chrome-tanned leather by the process of this invention, the procedure according to known methods is conveniently such that the leather is treated with an aqueous solution which contains at least one oligomer of the above kind, the tanned material is then rinsed, and subsequently as a rule fatliquored and dried. If the leather to be retanned is not already dyed, then it may, if desired, be dyed before it is fatliquored. Normally 100 to 200, preferably 150 to 200, parts by weight of water, and 2 to 50, preferably 5 to 10, parts by weight, based on the solids content, of at least one of the oligomers of the indicated kind, are employed per 100 parts of leather.

Preferred aqueous solutions for carrying out the retanning process, however, contain preferably 1 to 10, most preferably 2 to 5, parts by weight of oligomer as tanning agent.

The leather is normally treated with the aqueous solution containing the oligomer for 1 to 4 hours at 10° to 50° C., preferably 10° to 30° C. If the undyed leather is dyed with commercially available leather dyes, e.g. acid or metal complex dyes, the dye is conveniently added to the tanning liquor after the retannage has been effected, so that in this case rinsing is dispensed with. If, on the other hand, the leather is not dyed, then it is advantageous to rinse the leather briefly, e.g. for 15 to 30 minutes, with water at 10° to 50° C., preferably at 10° to 30° C. The retanned, dyed or undyed leather is then fatliquored with a conventional, preferably lightfast fatliquoring agent derived from e.g. sulfonated sperm oil or neat's foot oil. This fatliquoring is effected e.g. in the temperature range from about 30° to 80° C. over about 30 to 90 minutes. After the leather has been dried in the temperature range from about 30° to 80° C., it has excellent lightfastness, a fine, compact, smooth grain and, in particular, a soft handle. Very pale-coloured leather can additionally be obtained if undyed. The strong bleaching effect obtained in particular on chrome-tanned leather by the retanning process is especially advantageous. In addition, oligomers employed as tanning agents in the process of the invention have excellent compatibility with other commercially available tanning agents, so that these latter may be used together with the oligomers.

Suitable for use as chrome-tanned leather in the process of this invention is, in particular, wet blue leather comprising all types of leather, e.g. calf leather, cowhide, goatskin or sheepskin, and the chrome-tanned leather is normally neutralised before the retannage in conventional manner with e.g. formates or bicarbonates.

The invention is illustrated by the following Examples, in which parts and percentages are by weight.

PREPARATORY EXAMPLES FOR OLIGOMERS

EXAMPLE A

A solution of 165.3 parts (2.29 moles) of acrylic acid, 122 parts (2.29 moles) of acrylonitrile, 39.8 parts of 40% aqueous sodium hydrogen sulfite solution (0.153 mole) and 280 parts of deionised water is warmed to 29° C. To this solution are added, at 15 minute intervals, altogether 10×0.96 part (i.e. a total of 9.6 parts over 2½ hours) of a 1% ammonium persulfate solution, while cooling the reaction mixture such that the temperature rises to a maximum of 34° C. after each addition. The resultant white emulsion is then diluted with 96 parts of deionised water. The reaction mixture is then cooled to 20° C. and kept for 7 hours at this temperature. After this time the reaction mixture is kept for 2 hours under reduced pressure and a nitrogen atmosphere in order to remove nonreacted acrylonitrile. The emulsion is then adjusted to pH 6 with 287.3 parts of 30% aqueous sodium hydroxide solution (2.15 moles), while cooling the reaction mixture such that the temperature does not rise above 40° C. The reaction mixture is then cooled to 20° C., giving 1000 parts of a pale yellow, gel-like, clear aqueous solution containing 34% of an oligomer which contains about 15 structural units of the formula (1.4), about 15 structural units of the formula (2.2) and traces of the structural unit of the formula —$SO_3Na$.

EXAMPLE B

The procedure of Example A is repeated, using a solution consisting of 185.9 parts (2.58 moles) of acrylic acid, 64.7 parts (1.22 moles) of acrylonitrile, 19.8 parts (0.076 mole) of 40% sodium hydrogen sulfite solution, and 69.8 parts of water. To this solution are added a total amount of 19.8 parts of ammonium persulfate solution in 10 portions and, after dilution with 96 parts of water, 344 parts of sodium hydroxide solution (2.58 moles), giving 1000 parts of a pale yellow, gel-like, clear aqueous solution containing 31% of an oligomer which contains about 16 structural units of the formula (1.4), about 34 structural units of the formula (2,2) and traces of the structural unit of the formula —$SO_3Na$.

EXAMPLE C

The procedure of Example A is repeated, using a solution consisting of 185 parts (2.56 moles) of acrylic acid, 34 parts (0.64 mole) of acrylonitrile, 55.6 parts (0.124 mole) of sodium hydrogen sulfite solution, and 257 parts of water. To this solution are added a total amount of 10.7 parts of ammonium persulfate solution in 10 portions and, after dilution with 116.4 parts of water, 341.3 parts of sodium hydroxide solution (2.56 moles), giving 1000 parts of a pale yellow, gel-like, clear aqueous solution containing 28% of an oligomer which contains about 3 structural units of the formula (1.4), about 12 structural units of the formula (2.2) and traces of the structural unit of the formula —$SO_3Na$.

EXAMPLE D

The procedure of Example A is repeated, using a solution consisting of 138.3 parts (1.92 moles) of acrylic acid, 127.3 parts (2.4 moles) of acrylonitrile, 34.1 parts (0.48 mole) of acrylamide, 41.6 parts (0.16 mole) of sodium hydrogen sulfite solution, and 298.4 parts of water. To this solution are added a total of 11.4 parts of ammonium persulfate solution in 10 portions and, after dilution with 92.9 parts of water, 256 parts (1.92 moles) of sodium hydroxide solution, giving 1000 parts of a pale yellow, gel-like, clear aqueous solution containing 34% of an oligomer which contains about 3 structural units of the formula (3.2), about 15 structural units of the formula (1.4), about 12 structural units of the formula (2.2) and a trace of the structural unit of the formula —$SO_3Na$.

EXAMPLE E

The procedure of Example A is repeated, using an emulsion consisting of 211 parts (2.92 moles) of acrylic acid, 141.5 parts (1.64 moles) of vinyl acetate, 43 parts (0.165 mole) of 40% sodium hydrogen sulfite solution and 80 ml of water. To this solution are added, at 50° C., a total of 1.5 parts of a solution of ammonium persulfate in 25 ml of water in 10 portions and, after dilution with 155 parts of water, 320 parts (2.4 moles) of sodium hydroxide solution, giving 1000 parts of a pale yellow, gel-like aqueous solution containing 40% of an oligomer which contains about 10 structural units of the formula (1.3), wherein $X_4$ is —$COOCH_3$ and $Z_4$ is hydrogen, about 18 structural units of the formula (2.2) and traces of the structural unit of the formula —$SO_3Na$.

EXAMPLE F

A reactor is charged with 171 parts of water, then first with 74.9 parts (1.41 moles) of acrylonitrile, then with 101.7 parts (1.41 moles) of acrylic acid and finally with 24.3 parts (0.93 mole) of 40% aqueous sodium hydrogen sulfite solution. A solution of 0.6 part of ammonium persulfate in 6 parts of water is then added over 5 to 8 hours to the reaction mixture such that the temperature does not rise above 45° C. When the addition of catalyst is complete, 60 parts of water are added and the reaction mixture is kept for 5 hours at 75° C. To the reaction mixture are then added 146 parts of 30% aqueous sodium hydroxide over about 1½ hours such that the temperature does not rise above 50° C. The reaction mixture is subsequently heated to reflux temperature (98°–100° C.) and kept under reduced pressure of −0.8 to −1 bar for about 8 hours until a sample of the reaction mixture contains less than 100 ppm of unreacted acrylonitile. The reaction mixture is then cooled to 20° C. and adjusted to pH 6.1 to 6.3 by addition, in portions, of a total amount of about 22 parts of 30% aqueous sodium hydroxide solution, giving about 600 parts of a clear, slightly yellowish solution containing 33 to 34% of an oligomer which contains 25 to 30 structural units of each of the formulae (1.4) and (2.2).

EXAMPLE G

The procedure of Example A is repeated, using a solution consisting of 128.4 parts (1.78 moles) of acrylic acid, 144.2 parts (1 mole) of hydroxypropyl methacrylate, 47.4 parts (0.1 mole) of 25% potassium hydrogen sulfite solution, and 100 parts of water. To this solution are added, at 60° C., a total amount of 10 parts of ammonium persulfate solution in 10 portions and, after dilution with 351.5 parts of water, 218.5 parts (1.63 moles) of sodium hydroxide solution, giving 1000 parts of a slightly yellowish, gel-like, clear aqueous solution containing 31% of an oligomer which contains about 12 structural units of the formula (1.3), wherein $X_4$ is $—COOC_3H_6OH$ and $Z_4$ is methyl, about 22 structural units of the formula (2.2), and traces of the structural unit of the formula $—SO_3Na$.

EXAMPLE H

The procedure of Example A is repeated, using a solution consisting of 73.6 parts (0.51 mole) of 2-ethoxyethyl acrylate, 93.8 parts (1.30 moles) of acrylic acid, 33.6 parts (0.07 mole) of 25% aqueous potassium hydrogen sulfite solution and 60 parts of water. To this solution are added a total of 5 parts of ammonium persulfate solution in 5 portions at 60° C. and, after dilution with 565.8 parts of water, 168.2 parts (1.26 moles) of sodium hydroxide solution, giving 1000 parts of a clear aqueous solution containing 20% of an oligomer which contains about 7.3 structural units of the formula (1), wherein $X_1$ is $—COOR_1$, $R_1$ is 2-ethoxyethyl and $Z_1$ is hydrogen, about 18.5 structural units of the formula (2.2) and traces of the structural unit of the formula $—SO_3Na$.

EXAMPLE I

The procedure of Example A is repeated, using a solution consisting of 130.7 parts (1.81 moles) of acrylic acid, 120.3 parts (2.26 moles) of acrylonitrile, 26.3 parts (0.40 mole) of allyl alcohol, 72.6 parts (0.15 mole) of 25% aqueous potassium hydrogen sulfite solution, and 283.5 parts of water. To this solution are added a total of 37.8 parts of ammonium persulfate solution in 5 portions and, after dilution with 87 parts of water, 241.8 parts (1.81 moles) of sodium hydroxide solution, giving 1000 parts of a pale yellow, gel-like, clear aqueous solution containing 32% of an oligomer which contains about 2.6 structural units of the formula (3.1), wherein $Y_4$ is $—CH_2OH$ and $Z_6$ is hydrogen, about 15 structural units of the formula (2.2) and traces of the structural unit of the formula $—SO_3Na$.

EXAMPLE J

The procedure of Example A is repeated, using a solution consisting of 133 parts (1.84 moles) of acrylic acid, 149.4 parts (1.03 moles) of hydroxypropyl methylacrylate, 49 parts (0.10 mole) of 25% aqueous potassium hydrogen sulfite solution and 98.4 parts of water. To this solution are added a total amount of 12.2 parts of ammonium persulfate solution in 10 portions at 40° C. and, after dilution with 461.7 parts of water, 96.3 parts of 30% aqueous ammonium solution (1.7 moles), giving 1000 parts of a yellowish, gel-like, clear aqueous solution containing 31% of an oligomer which contains about 10 structural units of the formula (1.3), wherein $X_4$ is $—COOC_3H_6OH$ and $Z_4$ is methyl, about 18 structural units of the formula (2.1), wherein $Z_5$ is hydrogen, $Y_3$ is $—COOM_4$ and $M_4$ is an ammonium cation, and traces of the structural unit of the formula $—SO_3NH_4$.

APPLICATION EXAMPLES

EXAMPLE 1

100 parts of chrome-tanned calf leather which has been neutralised in conventional manner are retanned for 1½ hours at 30° C. with a solution consisting of 200 parts of water and 5 parts (based on the solids content) of the oligomer of Example A. The retanned leather is rinsed briefly, fatliquored in conventional manner with 4 to 6 parts of a lightfast fatliquoring agent derived from sulfonated sperm oil, and then dried. The leather has a pale colour of excellent lightfastness, a soft, full handle and a fine grain.

The same result is obtained using 5 parts of the oligomer of Example F instead of 5 parts of the oligomer of Example A.

EXAMPLE 2

100 parts of chrome-tanned sheepskin are put into 200 parts of water of 40° C. To the bath are then added 10 parts (based on the solids content) of the oligomer of Example B and the sheepskin is treated with this retanning liquor for 2½ hours at 40° C. The retanned leather is rinsed and then fatliquored with about 5 parts of a conventional fatliquoring agent and subsequently dried. The leather has a full, supple handle and a compact, fine grain. The same result is obtained using 10 parts of the oligomer of Example C instead of 10 parts of the oligomer of Example B.

EXAMPLE 3

100 g of chrome side shaved cowhide is neutralised, in a vat, in 200 parts of liquor in known manner, such that the pH of the leather remains below 4. To the bath are then added 6 parts (based on solids content) of the terpolymer of Example D and the neutralised leather is treated for 2 hours at 45° C. The leather is dyed in a fresh bath (300 parts) containing 1 part of the dye of the formula

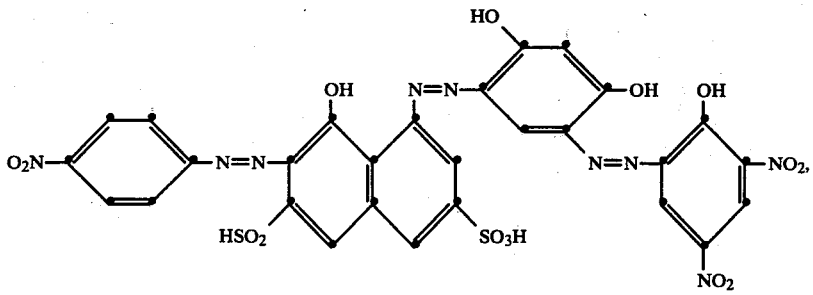

for 30 minutes at 60° C. The bath is acidified with 1 part of 85% formic acid over 30 minutes at 50° C. and then 3 parts of sulfated neat's foot oil are added to the exhausted bath and the leather is fatliquored for 60 minutes at 60° C. The leather is then racked and dried. After it has been staked, the leather has a good full, soft handle, a compact, fine grain and is dyed in a level, deep brown shade. The same result is obtained by replacing the terpolymer of Example D by 6 parts of the terpolymer of Example E, 6 parts of the copolymer of Example G, 6 parts of the copolymer of Example H, 6 parts of the terpolymer of Example I or 6 parts of the copolymer of Example J.

What is claimed is:

1. A process for retanning chrome-tanned leather, which process comprises treating the leather with an aqueous solution containing, as tanning agent, an oligomer which has an average molecular weight no greater than 14,000 and which contains structural units of the formulae

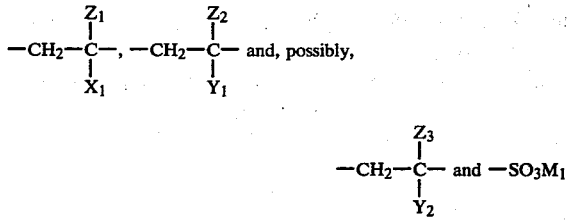

wherein $X_1$ is —CN, $Y_1$ is —COOH or —$COOM_2$, $Y_2$ is —$CONH_2$, —$CH_2OH$, —$OCH_3$ or —$OC_2H_5$, each of $Z_1$, $Z_2$ and $Z_3$ is hydrogen, methyl or ethyl, and each of $M_1$ and $M_2$ is an amine cation, an ammonium cation or an alkali metal cation.

2. A process according to claim 1, wherein the tanning agent is an oligomer which contains 2 to 75 structural units of each of the formulae

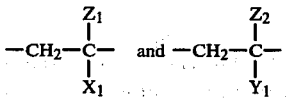

and 0 to 25 structural units of the formula

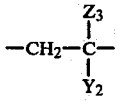

3. A process according to claim 1, wherein $Y_2$ is —$CONH_2$, —$CH_2OH$ or —$OCH_3$, each of $M_1$ and $M_2$ is a sodium cation, potassium cation or ammonium cation, and each of $Z_1$, $Z_2$ and $Z_3$ is hydrogen or methyl.

4. A process according to claim 1, wherein 2 to 50 parts by weight, based on solids content, of oligomer as tanning agent are used per 100 parts by weight of leather.

5. A process according to claim 1, which comprises treating the leather for 1 to 4 hours at 10° to 50° C. with the aqueous solution containing the oligomer as tanning agent.

6. A process according to claim 1, which comprises treating dyed or undyed leather with the aqueous solution containing the oligomer as tanning agent, rinsing the so treated leather, and fatliquoring and drying it.

7. A process according to claim 1, which comprises treating undyed leather with the aqueous liquor containing the oligomer as tanning agent, dyeing the so treated leather, and fatliquoring and drying it.

* * * * *